US005257782A

United States Patent [19]

Schicketanz

[11] Patent Number: 5,257,782

[45] Date of Patent: Nov. 2, 1993

[54] RACKET GRIP-ENHANCING DEVICE

[76] Inventor: J. Scott Schicketanz, 123 Pearl Ave., Balboa Island, Calif. 92662

[21] Appl. No.: 836,366

[22] Filed: Feb. 18, 1992

[51] Int. Cl.[5] ..... A63B 49/08

[52] U.S. Cl. ..... 273/73 J; 273/73 R; 273/7 J

[58] Field of Search ..... 273/73 R, 73 C, 73 J, 273/75, 67 R, 72 R, 81 R, 81 C, 81 D, 165, 166, 81.2, 81.3

[56] References Cited

U.S. PATENT DOCUMENTS

| | | | |
|---|---|---|---|
| 2,273,416 | 2/1942 | Norwood | 273/166 |
| 2,566,215 | 8/1951 | La Croix | 273/73 R |
| 3,203,697 | 8/1965 | Berzatzy | 273/75 |
| 3,533,630 | 10/1970 | Lo Monaco | 273/165 |
| 3,693,973 | 9/1972 | Wattenburg | 273/73 R |
| 3,712,618 | 1/1973 | Berzatzy | 273/75 |
| 3,814,419 | 6/1974 | Bjorklund et al. | 273/73 R X |
| 3,951,416 | 4/1976 | Koch et al. | 273/166 X |

*Primary Examiner*—V. Millin
*Assistant Examiner*—Raleigh W. Chin
*Attorney, Agent, or Firm*—G. Donald Weber, Jr.

[57] ABSTRACT

This invention comprises a grip-enhancing device which enables increased shot-making power and control for all games rackets. In particular, the device includes two helically-oriented, hand-retaining surfaces disposed at or near the handle end of the racket. The hand-retaining surfaces bear against the rear surfaces of the hand adjacent to the thumb and heel portions of the hand. The entire device is adapted to rotate relative to the handle. While not so limited, the invention is especially useful for physically impaired players.

7 Claims, 1 Drawing Sheet

RACKET GRIP-ENHANCING DEVICE

BACKGROUND

1. Field of the Invention

This invention is directed to an improved racket for use in games, in general, and to an attachment selectively attached to such rackets, in particular.

2. Prior Art

Rackets employed in racket-and-ball games such as tennis, racquetball, squash and badminton have a ball-striking end, hereinafter referred to as the racket head, and a handle portion at the other end. For purposes of this discussion, the terminus of the handle at the opposite end of the head is the handle end. Typically, such rackets have a gripping portion, hereinafter referred to as a grip, which is the surface of the handle adjacent to said handle end. The grip is, generally, an irregular polygon, for example an octagon or hexagon, in cross-section.

Currently, various anti-slip tapes and wrappings, together with a slight uniform flaring near the handle end, are the only means allowing a player to retain the racket in his/her grasp during racket strokes. Therefore, players must maintain marked flexion in the gripping muscles of the hand and forearm to resist the angular momentum of the racket. This state of perpetual flexion reduces power from shots where fluid wrist movement is desirable. It is also tiring and is inconsistent with subtle racket control.

Players commonly rotate the racket relative to the gripping hand to adjust the rake (or tilt) of the racket head. Right-handed players, for example, when rotating the racket from the forehand to the backhand gripping positions, rotate the racket towards the thumb so the stroke will impart topspin to the ball. Current racket grip configurations present relatively featureless surfaces, and the player must try to feel the subtle contours of the grip for reference as to the racket rake.

The instant device presents two adjustable and unitarily rotating hand-retaining surfaces with, among others, the following objectives:

To decrease the forearm and hand muscle flexion required to retain the racket in the player's grasp during racket strokes, thereby decreasing the effort required to achieve the desired racket head speed, and increasing the power and control of all shots.

To avoid, as far as possible, the tiring of gripping muscles, especially in the cases of very young, very old, or weak players.

To evenly distribute the forces bearing on the hand during strokes to the ulna and radius bones of the forearm.

To precisely establish racket head rake for forehand, backhand and service strokes according to the individual player's preference.

To simplify and speed the process by which the player shifts the grip from one position to another.

To provide greater surface area of contact between the player's hand and the racket, thereby providing increased tactile feedback from the racket and increasing racket "feel".

It is another and further object of the system of attachment of the device to permit the use of the device with any and all games rackets.

PRIOR ART STATEMENT

U.S. Pat. No. 4,351,528; SPORTS STICK HANDLE; J. R. Duplin. This patent describes a hockey stick having a main shank which has a polygonal cross-sectional and a notch recess for receiving the hand of the user.

U.S. Pat. No. 4,213,609; GRIP BUMPER; A. P. Swanson. This patent describes a grip for fitting around the handle of a racket the like having continuous outturned peripheral rib for receiving and restraining the hand of the user.

U.S. Pat. No. 4,351,529; RACKET HANDLE; D. E. Schultz. This patent describes a game racket with the upper surface and at least a portion of the rear surface of the handle being substantially smooth and an enlarged front portion of the handle end.

U.S. Pat. No. 4,659,080; RACQUET HANDLE; L. D. Stoller. This patent describes a tennis racket wherein the handle is offset by 13° from the major axis thereof.

U.S. Pat. No. 4,128,240; TENNIS RACKET; A. J. Berokoff. This patent describes a tennis racket having a hand grip with a hole therethrough for receiving a finger of the user.

U.S. Pat. No. 4,101,125; ADJUSTABLE TENNIS RACKET; G. Heath. This patent describes a tennis racket including a hand grip which is rotatably mounted on the outer end of said handle for limited angular displacement relative to the head and handle.

U.S. Pat. No. 4,153,249; BIOENGINEERED GAME RACKET; S. C. Plagenhoef. This patent describes a tennis racket having weights mounted thereto and a bulge in the handle for positioning a grip.

U.S. Pat. No. 4,349,199; RACQUET HANDLE; R. Vulcano. This patent describes a racket having a handle which includes first and second parallel, longitudinally extending, minor surfaces positioned in transverse cross-section, normal to the plane of the striking face and a pair of longitudinally extending, relatively angled, major surfaces which, in transverse cross-section, are inclined with respect to said first minor surface.

U.S. Pat. No. 4,226,418; GAME RACKET HAND GRIP; R. S. Balfour. This patent describes a game racket which includes a handle which has a hand grip comprising a tubular member secured to the handle and a plurality of finger-receiving holes extending therethrough.

SUMMARY OF THE INSTANT INVENTION

The grip-enhancing device disclosed herein consists of two hand-retaining surfaces which extend from a support. The device is mounted at the end of the racket handle and rotates in a plane perpendicular to the main axis of the racket handle. Both surfaces and the support rotate as a unit within a precisely determined arc of rotation.

The surfaces of the device contact and retain at least a portion of the two fleshy edges of the hand during play, i.e. adjacent the base of the thumb and the heel of the hand. Thus, the device at least partially delegates the task of restraining the racket grasp against angular momentum to the retaining surfaces and away from the gripping surfaces of the hand.

The preferred orientation and configuration of the retaining surfaces are best achieved when accurately mirroring the orientation and configuration of the germane edges of the hand while the player is comfortably and correctly gripping the racket. The degree of unitary rotation of the surfaces is correct when it corresponds accurately with the amount of rotation ideal between the "forehand" and "backhand" (and sometimes "serve") gripping positions of an individual. The instant device and system of attachment permit the adjustment of the orientation, configuration and degree of rotation of the surfaces.

DESCRIPTION OF THE PREFERRED EMBODIMENT

Figure 1:
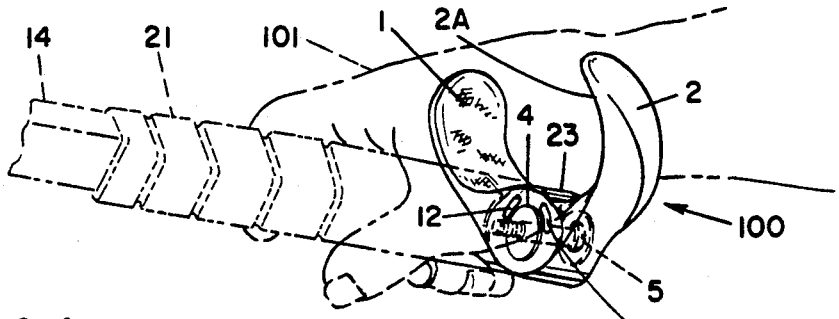
FIG. 1 is a perspective view of a preferred configuration and orientation of the grip-enhancing device attached to a phantom representation of a racket handle for a right-handed application.

The drawings are provided for illustrative purposes only and not by way of limitation of the invention.

Referring concurrently to FIGS. 1 through 5, there is shown a preferred configuration of the grip-enhancing device 100 of the instant invention suitable for right-handed players. The left-handed configuration is essentially reversed.

A typical racket handle 14 is shown in dashed outline. The handle can be fabricated of wood or metal and is part of a game racket, such as, but not limited to, a tennis racket. A helically-wound retaining surface 21 is provided as the handle grip. The surface 21, typically of leather or the like, ascends roughly one unit of distance towards the racket head for each unit of displacement around the handle. The surface 21 covers about 30–50 percent of the length of the racket handle. An inner retaining surface (not shown) can be provided in the opposite direction up and around the handle in an equivalent helical disposition.

The device 100 is adapted to be attached to the end of handle 14 and includes two curvilinear arms 1 and 2, respectively. These arms are attached to a common support 23 and are adpated, generally, to encircle the user's hand 101 (shown in dashed outline in FIG. 1). The support 23 is attached to the butt end of racket handle 14 by a rotating suspension system including screw 5 and washer 4. It can be seen that the inner ends of the retaining surfaces 1 and 2 clear the racket handle 14 to permit free rotation thereof.

More particularly, the screw 5 passes through an axial bore in support 23 and extends into the end of handle 4. Support 23 is free to rotate around screw 5. The washer 4 provides a reduced friction bearing surface between the end of the racket and the bearing surface of support 23.

Both arms 1 and 2 are generally rigid and are gently concave. The arms 1 and 2 are generally rigid for the portion adjacent to the front of the player's hand at the point of greatest mutual divergence. This rigidity is necessary to prevent any slippage of the hand on the grip during strokes. For the portion of the arms 1 and 2 which approach each other across the back of the hand (see FIG. 4), some flexibility may be incorporated, so long as there is sufficient rigidity to maintain the position of the hand within the device.

The forward and trailing edges of the arms 1 and 2 are preferably turned down and away from the racket head, so that uncomfortable edges are not felt during play. The ends of arms 1 and 2 which are outermost from the support 23 are somewhat turned up towards the racket head.

In a preferred embodiment, arm 2 is configured to be positioned farther up along the handle 14 towards the racket head than is arm 1. This arrangement is in keeping with the natural position of the hand on the grip 14. (In a device suitable for left-handed players, the relative height of the two arms is reversed.) The arms may be positioned directly adjacent to the grip surface 21 and/or beyond the end of the racket handle, in an adjustable fashion.

As noted, the device 100 is shown rotatably attached to the racket 14 by a suspension system which allows for user-adjustable combined retaining surface "height" along the grip, user-selectable combined retaining surface range of rotation and user-selectable combined retaining surface shock absorption. The retaining arms 1 and 2 must rotate to avoid interfering with the grip shifts used in racket sports, like tennis. In racket sports where only one grip is used, the device 100 may be immovably affixed to the end of racket handle 14 by tightening screw 5, for example.

Figure 2:
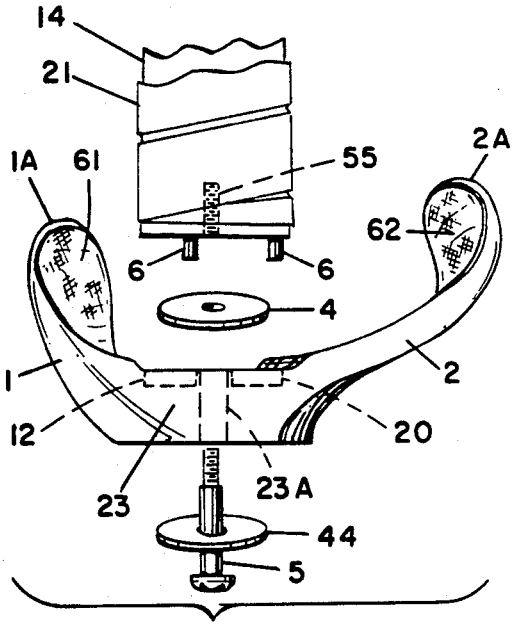
FIG. 2 is an exploded elevational view of the back of a preferred embodiment of the grip-enhancing device of the instant invention.

As seen best in FIG. 2, the arms 1 and 2 have retaining surfaces 1A and 2A on the upward facing surfaces thereof, respectively. The retaining surfaces 1A and 2A are used to contact the hand 101 of the user (see FIG. 1). In particular, retaining surface 2A (on the reverse side of arm 2) contacts and retains a portion of the edge of the hand between the base of the thumb and the inside of the wrist. Similarly, retaining surface 1A contacts and retains a portion of the edge of the hand between the base of the little finger and the outside of the wrist. It is desirable to provide retaining surfaces for both of these areas of the hand in order to avoid asymmetrically loading either the ulna or the radius bones of the forearm with the force of the angular momentum of the racket during strokes.

The device 100 can, typically, be fabricated of a hard, rigid polycarbonate resin material such as is manufactured and sold under the registered U.S. trademark LEXAN to form the outer shell. The contours of the retaining surfaces 1A and 2A may be changed according to individual preference by altering the original design, by bending the arms (when malleable material is used), or by the addition of padding 61 and 62 on the surfaces 1A and 2A, respectively. The padding can be gauze, rubber, felt, leather or any other suitable material. For example, the padding 61 and 62 can be provided in the form of a viscous gel. The shell will retain its shape while the gel will tend to conform to the user's hand. The use of padding provides areas of comfortable mutual contact between the retaining surfaces of the arms 1 and 2 and the back or front of the hand and the retaining surfaces and, as well, may increase the relative difference in "height" along the grip of the two arms.

The distance between the support 23 and the handle 14, and thereby the "height" along the grip of the retaining surfaces 1 and 2, may be increased by the substitution of a thicker friction-reducing washer 4 between the handle 14 and the support 23. Alternatively, the height of the retainer may be decreased by the substitution of a thinner washer. If a player desires that the retaining surfaces be substantially closer to the racket head than the area near the end of the handle, the handle may be shortened. Alternatively, the support 23 can be fashioned so that it proceeds up and alongside the surface of the racket grip for some distance before the retaining surfaces project out from it, thereby decreasing the distance between the surfaces and the racket head. In addition, the arms 1 and 2 and the retaining surfaces 1A and 2A may continue farther around the back of the player's hand, if desired. In some cases, the surfaces may meet and connect behind the hand.

In the preferred embodiment, the support 23 has flat upper and lower surfaces. In addition, support 23 should be strong enough to resist the tendency of the retaining arms 1 and 2 to deflect down and away from the racket head during strokes. It should also be sufficiently strong so as to prevent any independent movement of the arms, so that the convex unitary receptacle precisely formed for the hand is of unvarying dimension during force loading.

The support 23 has an axial bore 23A therethrough, perpendicular to the plane of the upper and lower surfaces of support 23. In practice, the bore 23A aligns with bore 55 provided along the main axis of the handle 14. A fastener 5, typically a screw, attaches to handle 14 and retains the support 23 (and thereby the support surfaces) thereto. In order to allow the connective means to rotate freely around fastener 5, it is desirable to insure that the interface between the fastener 5 and the bore is relatively frictionless. In addition, friction-reducing washers 4 and 44 are placed around the shaft of fastener 5 on opposite sides of support 23. In particular, washer 4 is located between the support 23 and the handle end 14 while washer 44 is located between the support 23 and the head of the fastener 5.

Figure 3:
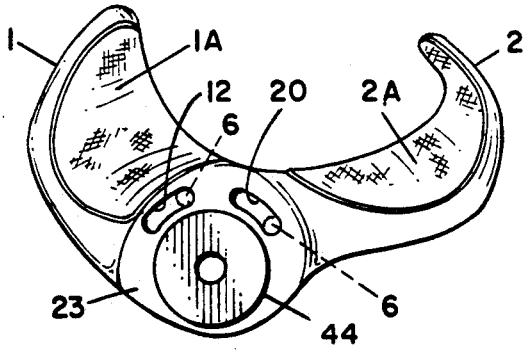
FIG. 3 is a plan view of the top of a preferred embodiment of the grip-enhancing device of the instant invention.

In one embodiment, the device 100 may include rotation limits which are referenced to the player's preferred grip position for forehand and backhand shots. (It is possible that a limit of rotation referenced to a player's serving grip position can also be provided, if desired.) The rotation limiting arrangement is best seen in FIGS. 2 and 3, and includes stops 6 which are attached to and extend from the end of handle 14. In this embodiment, concentric slots 12 and 20 are formed in the upper surface of support 23. The slots receive the stops 6 in the handle 14. The slots are of uniform width sufficient to permit easy passage of the stops 6 along the length thereof. In practice, the device may freely rotate up to the point where the stops abut the ends of the slots. The number of slots and stops may be any number from one to several.

The stops 6 can take any form wherein they are sufficiently strong and rigid to abruptly stop the rotation of the device without breaking. Also, the ends of the concentric slots are only one of a large possibility of points of abutment for the stops. Thus, for example, the stops could be positioned very near the rim of the handle end and abut concentric cutouts at the rim of the support 23 wherein the rotation limiting means would have a longer lever arm against rotation.

Within the context of the attachment system herein disclosed, the sweep of the arc of rotation of the device would be equal to the degree of arc comprising the concentric slots 12 and 20, minus the degree of arc taken up by the stops 6. Therefore, the angle of rotation may be increased by lengthening the slots, and decreased by substituting stops which occupy a greater section of said slots or adding stops concentric to the existing ones within the same slot.

A tactilely identifiable intermediate position between the previously mentioned absolute rotation limits may be achieved through the use of a very shallow tongue-and-groove arrangement (not shown) between the friction-reducing washer 4 at the handle end and the support 23, which tongue-and-groove arrangement would not interfere substantially with the free rotation of the device.

In an alternative embodiment, washer 4 may include one or more detents, such as bumps or depressions which interact with complementary depressions or bumps or the end of the racket handle 14. The detents can be used to define selected positions of the racket, e.g. forehand, backhand, serve or the like.

It is contemplated that interchangeable arms 1 and 2 could be provided which would attach and detach from the support 23. Such interchangeable arms can have differing contours, dimensions and/or helical orientations relative to the handle 14. It is also possible that the support 23 between the interchangeable retaining arms could permit limited fore-and-aft rotation of the retaining surfaces, wherein the helical orientation of the surfaces would change during play according to the relative pressure exerted on the leading or trailing portions of said surfaces.

Figure 4:
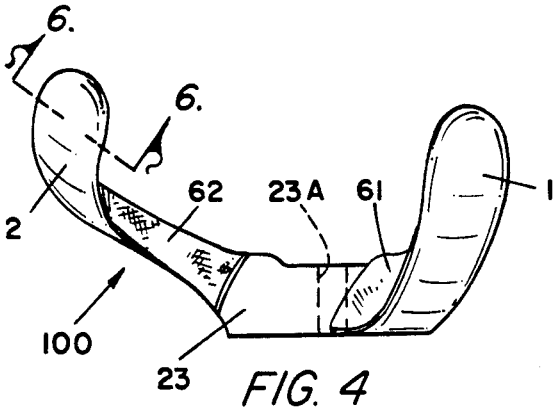
FIG. 4 is an elevational view of the front of a preferred embodiment of the grip-enhancing device of the instant invention.

Referring now to FIG. 4, there is shown an elevational view of the back of device 100. In this view, the configuration of arms 1 and 2 as well as the relationship to support 23 is depicted. The padding 61 and 62 is shown on the surfaces of arms 1 and 2. Of course, the padding can be made of anti-slip material to enhance the user's grip.

Figure 5:
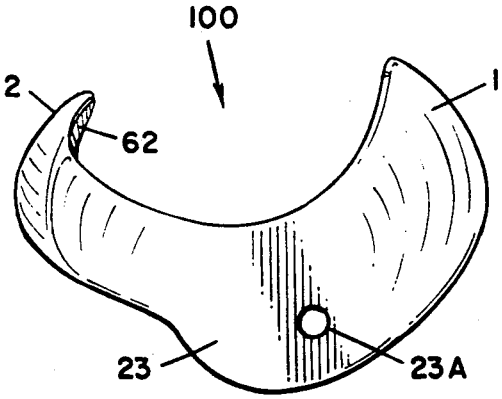
FIG. 5 is a plan view of the bottom of a preferred embodiment of the grip-enhancing device of the instant invention.

Referring now to FIG. 5, there is shown a bottom plan view of the device 100. In this view, the relationship between arms 1 and 2 and the support 23 is shown. Typically, the arms extend smoothly from the support.

Figure 6:
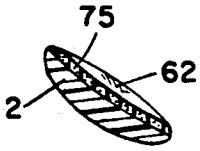
FIG. 6 is a cross-sectional view of a preferred embodiment of the grip-enhancing device of the instant invention taken along the lines 6—6 in FIG. 4.

Referring now to FIG. 6, there is shown a cross-sectional view of arm 2 of the device 100 as taken along the lines 6—6 in FIG. 4. In this view, the arm 2 comprises a relatively rigid support. A padding 62 of any type described above is mounted on the arm 2. In this showing, an adhesive 75 is used to adhere the padding 62 to the arm 2. The adhesive may take any form desired and/or appropriate. Typically, adhesive layer 75 is relatively thinner than shown in FIG. 6.

Figure 7:
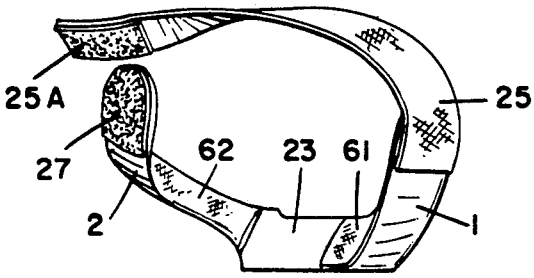
FIG. 7 is an elevational view of the front view of another embodiment of the grip-enhancing device of the instant invention with a wrist retaining strap attached thereto.

Referring now to FIG. 7, strap 25 can be attached to one arm. A hook-and-loop fastener 27 is mounted on the other arm. The strap 25, per se, or with a complementary hook-and-loop fastener 25A, is selectively attached to fastener 27. This provides a secure grip and, as well, reduces the chance of the racket being dropped by the user.

In the interest of comfort and a very sure grip, it may be desirable in some cases to shave the end portion of the racket grip surface and create a concavity instead of the previously mentioned uniform flare for only the portion of the handle end which is proximate to the retaining surfaces. However, this is not part of the invention, per se.

Thus, there is shown and described a unique design and concept of an improved racket for use in games. The particular configuration shown and described herein relates to grip-enhancing device which is attached to the racket handle. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

I claim:

1. A combination of a game racket handle and a grip-enhancing device for use with a game racket handle, said grip-enhancing device comprising, two hand-retaining surfaces rotatably mounted adjacent one end of said racket handle, said two hand-retaining surfaces are helically-formed, said two hand-retaining surfaces are joined together to form a common support and to rotate around the main axis of said racket handle.

2. A combination of a game racket handle and a grip-enhancing device adapted to be attached to the end of a racket handle, said grip-enhancing device comprising, a pair of retaining arms, and a support means to which each of said retaining arms is attached, said pair of retaining arms arranged mutually opposed to each other to engage therebetween the hand of a user of said racket handle, said pair of arms extend from opposing sides of said support means.

3. The device recited in claim 2 including, friction reduction means adjacent to said support means and disposed between said support means and said racket handle when said grip-enhancing device is attached to said racket handle.

4. The device recited in claim 3 wherein, said friction reduction means includes washer.

5. The device recited in claim 2 including, rotation limiting means at said support means and disposed between said support means and said racket handle when said grip-enhancing device is attached to said racket handle.

6. The device recited in claim 5 wherein, said rotation limiting means includes at least one slot in said support means adapted to engage said racket handle when said grip enhancing device is attached to said racket handle.

7. The device recited in claim 2 including, padding means disposed on at least one of said pair of retaining arms.

* * * * *